US006350223B1

(12) United States Patent
Niedermeyer

(10) Patent No.: US 6,350,223 B1
(45) Date of Patent: Feb. 26, 2002

(54) ROLLS TO FOLD, CUT, OR ADVANCE SEGMENTS IN FOLDING APPARATUS

(76) Inventor: William P. Niedermeyer, 1024 Mt. Mary Dr., Green Bay, WI (US) 54311

( * ) Notice: Subject to any disclaimer, the term of this patent is extended or adjusted under 35 U.S.C. 154(b) by 0 days.

(21) Appl. No.: 09/481,108

(22) Filed: Jan. 11, 2000

(51) Int. Cl.[7] ..... D06F 89/00

(52) U.S. Cl. ..... 493/359; 493/357

(58) Field of Search ..... 493/359, 123, 493/313, 315, 316, 317, 318, 194, 199, 357, 340

(56) References Cited

U.S. PATENT DOCUMENTS

| | | | | | |
|---|---|---|---|---|---|
| 4,494,741 | A | * | 1/1985 | Fischer et al. | 493/433 |
| 4,529,141 | A | * | 7/1985 | McClenathan | 242/56 |
| 5,411,245 | A | * | 5/1995 | Springer et al. | 493/432 |
| 5,795,433 | A | * | 8/1998 | Niedermeyer | 156/479 |
| 5,904,277 | A | * | 5/1999 | Niedermeyer | 493/416 |

* cited by examiner

*Primary Examiner*—Rinaldl I. Rada
*Assistant Examiner*—Gloria R Weeks

(57) ABSTRACT

A hollow roll assembly for cutting, advancing, and folding segments when used in a folding machine, including discreet transversely extending vacuum conduits superposed against the inside surface of a rotating roll. The conduits have closed ends, apertures in one surface connecting the conduit to vacuum ports on the surface of the roll, and open sliding connections communicating with vacuum grooves in a non-rotating vacuum valve. The conduits also have apertures in another surface to communicate with vacuum grooves in the inside of the roll and extend vacuum to side margins of the segment. Similar conduits are provided for air with connections to surface apertures at one end and a pressurized air source at the other end. In another embodiment of the roll assembly, anvils and roll stiffening means are provided. In other embodiments, rolls include a pre-molded section having air and vacuum conduits for use in single or double fold applications. In all embodiments, the pre-molded plastic or prefabricated tubing can have a closed end and an end with sliding connections on both ends to cooperate with two stationary valves. In the preferred embodiment, a single vacuumized roll with anvils completes a singlefolded product versus two vacuumized rolls required for present art machines, and can complete a doublefold with one roll versus three vacuumized rolls with present art machines.

13 Claims, 5 Drawing Sheets

DOUBLEFOLD

SINGLEFOLD

SINGLE / DOUBLE

ROLL LEGEND

K..... KNIFE CUTOFF - NOT VACUUMIZED
A..... VACUUM ANVIL / FOLDING / TRANSPORT
F..... VACUUM CARRIER / FOLDING / TRANSPORT
C..... VACUUM CARRIER FOR TRANSPORT ONLY

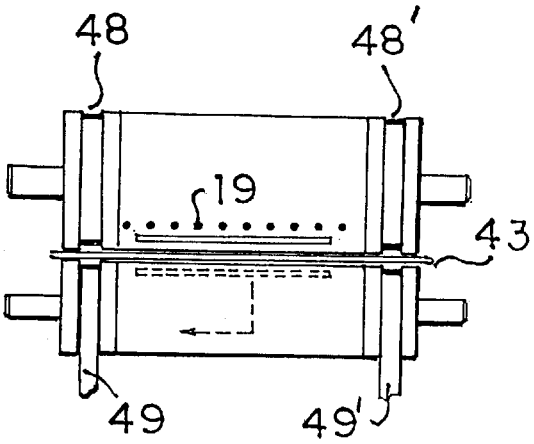
FIG. 14
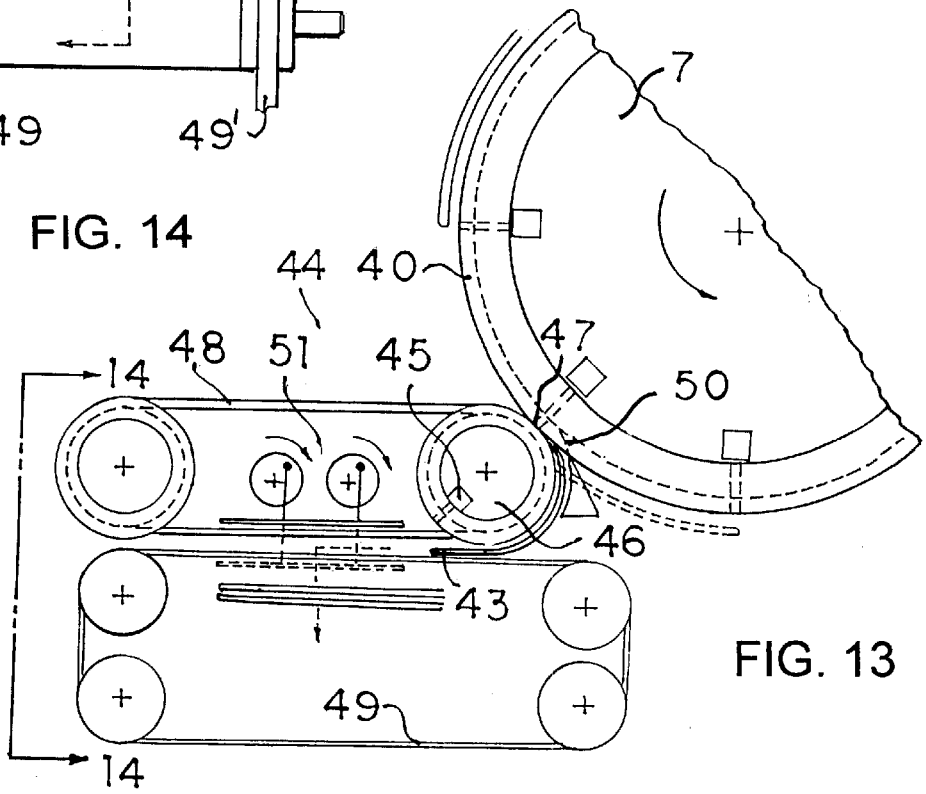
FIG. 13
FIG. 15
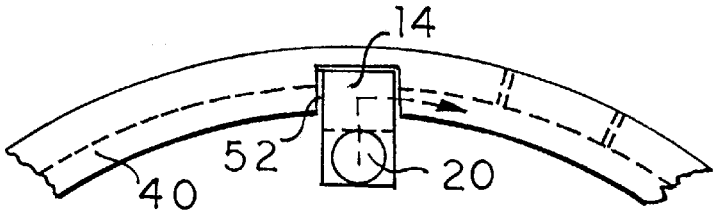
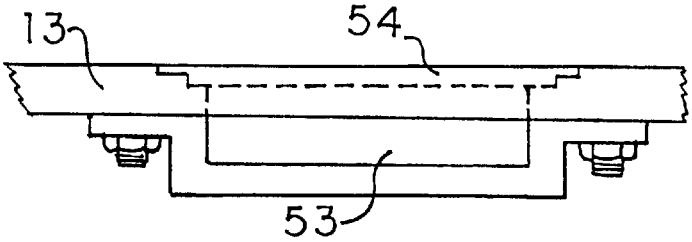
FIG. 16

ROLLS TO FOLD, CUT, OR ADVANCE SEGMENTS IN FOLDING APPARATUS

BACKGROUND OF THE INVENTION

Prior art napkin making machines using mechanical tuckers and grippers are based on U.S. Pat. Nos. 2,054,426 and 2,057,879 granted to Campbell (1936).

In 1934, U.S. Pat. No. 1,974,149 to Christman describes vacuum folding techniques used in machines for making longitudinally and single transversely folded products like napkins—referred to as quarterfolded napkins.

In the 1970's U.S. Pat. Nos. 3,689,061 to Nystrand and 3,870,292 to Bradley extended vacuum folding to machines that make a second transverse fold for dinner napkins—referred to as eigthfold napkins.

For example, the '051 apparatus of Nystrand uses a vacuumized anvil/folding roll (F) to selectively advance, foldback, and superpose the leading half panel of a segment over the trailing half and release the lead panel while the trailing half panel is held and advanced.

In '061, the carrier/folding vacuum roll (F) coacts with a vacuumized transport roll (C) to complete the second transverse fold (doublefold).

Present state fo the art vacuum folders operate with the same folding principles used for the past 60 years and include vacuum carrier rolls, combination anvil carrier rolls, and vacuum folding rolls made from solid blanks or solid steel forgings. machine to be processed without off-line unwinding and slitting to widths suitable for converting and are describes in a co-pending U.S. patent application Ser. No. 09/499242.

The objects of the instant roll design are detailed below.

SUMMARY OF THE INVENTION

The object of this invention is to provide hollow rolls with separate internal vacuum and air conduits that can be assembled from discreet components to overcome weight, diameter, and roll length limits of present vacuum transport, cutting, and folding rolls.

A further object is to provide conduits superposed against the inside surface of hollow rolls to minimize the length of drilled connections between air/vacumn conduits and openings in the surface of the rolls.

An object of the invention is to provide larger conduits for low pressure high volume air conduits rather than large diameter holes drilled into solid roll blanks.

An object is to provide larger diameter cylinders with multiple repeats and substantial internal space to avoid the diameter limits for holes drilled in solid rolls because of the restricted area of small diameter rolls for shorter product repeats.

A further object is to provide closed air plenum chambers using the inside surface of the roll as a portion of the plenum chamber closure.

An object is to provide a plenum against the inside surface to minimize the length of, or eliminate, air channels to openings in the surface of the roll.

An object of the above stated plenum with a replaceable surface section is to allow different patterns of air apertures to extend as longitudinal slots, substantially 'open mesh' segment support surfaces, or patterns of holes in the roll surface.

A further object of the air plenum is to allow the operative surface pattern of the plenum chamber to be changeable for different air flow volumes.

An object of the invention is to provide lighter weight hollow rolls of larger diameter having an extended circumferential path for use of more than one stationary fold completion device thereby eliminating the separate cooperating vacuum roll usually needed for a second transverse fold.

Another object is to provide for surface mounting of anvils and internal support means to increase roll stiffness.

Another object is to provide hollow roll construction having a hollow central shaft and roll supports between the roll shell and central shaft.

A further object of this is to provide air/vacuum conduits that can be prefabricated or pre-molded from plastics to complete the internal passages between air/vacuum sources and connections to vacuum ports and air apertures.

The above listed objects describe benefits that derive from the hollow roll and the benefits of greater productivity from wider, larger diameter rolls and air folding, etc. more clearly described in the abovementioned co-pending U.S. Patent Application.

Other objects may be seen in the ensuing specifications.

BRIEF DESCRIPTION OF THE DRAWINGS

FIG. 10 does not have air blast conduits.

FIG. 13 is a side elevation illustrating the main vacuum folding roll coacting with a vacuum transport roll of similar construction to remove completed product from the path of advancement.

FIG. 14 is a side elevation of the one-time repeat transfer roll of FIG. 13 illustrating side margin belt grooves for belts which enclose and control the folded product being withdrawn from the path.

FIG. 15 is a side cutaway view illustrating a shaped vacuum conduit mounted in a slot machined transversely on the inside of the roll.

FIG. 16 is a partial side elevation illustrating an air plenum mounted against the inside surface and including a removable section of the outside surface.

In FIG. 5, vacuum groove V 1 is timed and adjusted to hold the leading half panel until the first air blast A 1. Vacuum in V 2 groove is maintained until air blast A 2 blows the leading quarter panel outward before the double fold is completed by stationary plate 5.

In FIG. 6, conduit 11' is held by clamp 12 against the inside surface of cylinder 13.

Figure 1:
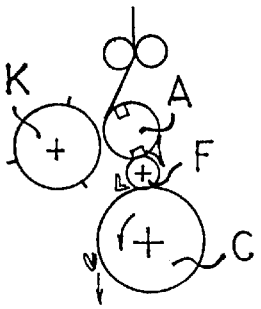
FIG. 1 PRIOR ART
FIG. 1 is a side elevation schematic of a prior art folder illustrating web path, fold sequence, and roll combinations for vacuum folding a double transversely folded article.
Figure 2:
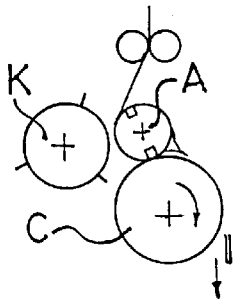
FIG. 2 PRIOR ART
FIG. 2 is a side elevation schematic similar to FIG. 1 for vacuum folding a single transversely folded product.
Figure 3:
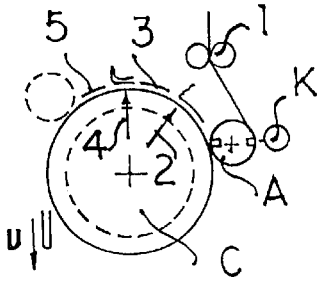
FIG. 3 PRIOR ART
FIG. 3 is a side elevation schematic of the folder apparatus of U.S. Pat. No. 5.904,277 illustrating the use of radially outward air flow and stationary plates to complete single and doublefolded products advanced by a single carrier roll.
Figure 4:
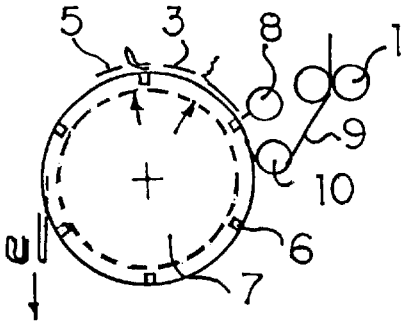
FIG. 4 is a side elevation schematic of a folder similar to FIG. 3 with the carrier roll having anvils which coact with an adjacent and separate knife roll.

A circular extension 16 (shown at top left side of FIG. 12) passes through cylinder end piece 17 (also see left side of FIG. 9 ), and is in sliding contact with vacuum groove V 1 to supply vacuum to surface ports 19 via channels 18 drilled through the shell of cylinder 13.

Figure 6:
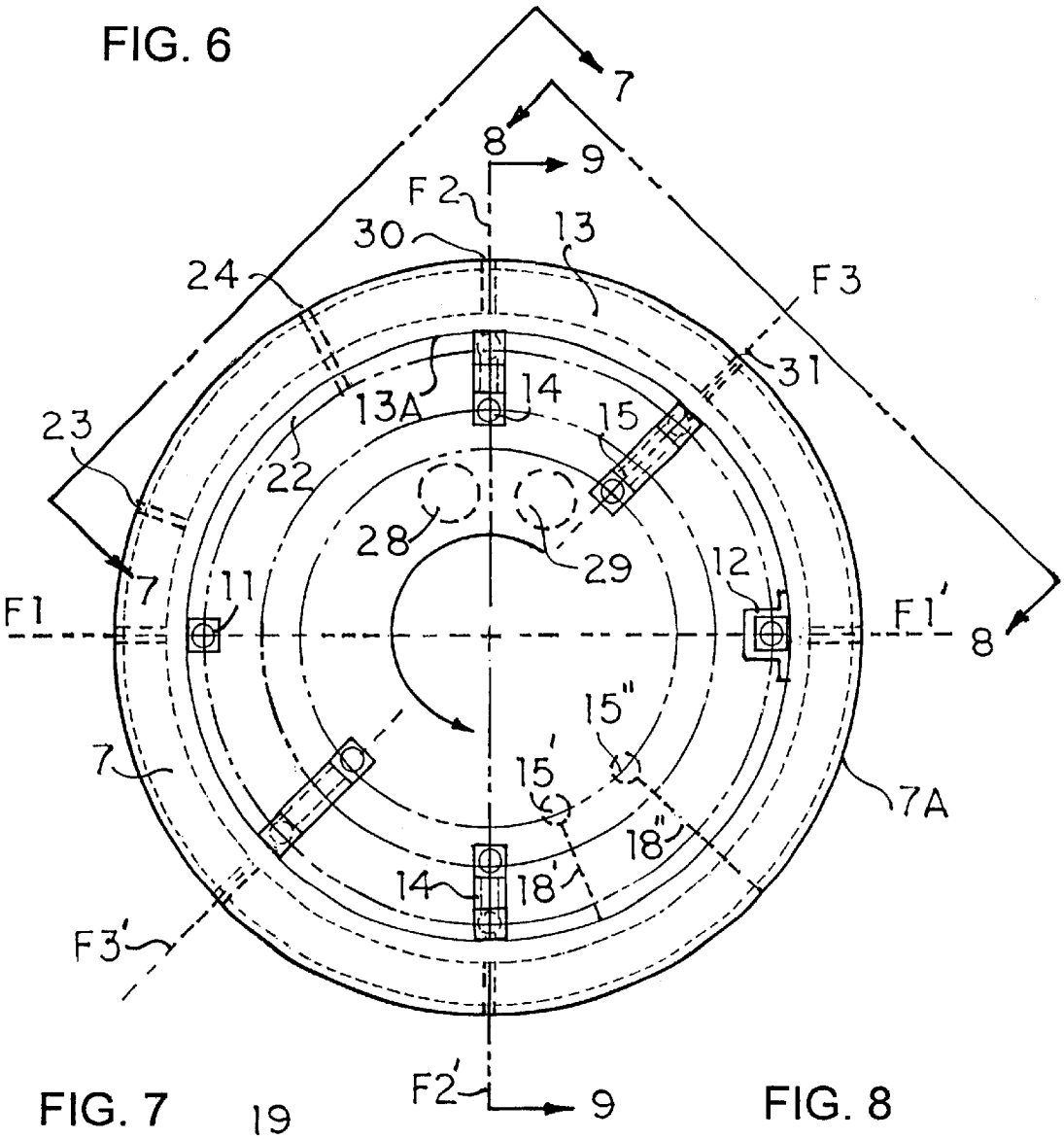
FIG. 6 is a sectional end elevation of a 2-time, two repeat roll viewed from sight line 6—6 of FIG. 9 illustrating the arrangement, structure, and terminal connections as applied to three vacuum grooves V1–V3.

In FIG. 6, conduit 14 (shown as the middle conduit in FIG. 12) includes offset member 20 with apertures 21 to complete a vacuum path from vacuum groove V 2 and sliding connection 16' through aperture 21 in piece 20, conduit 14, and surface ports 30 drilled through the shell of cylinder 13.

Figure 12:
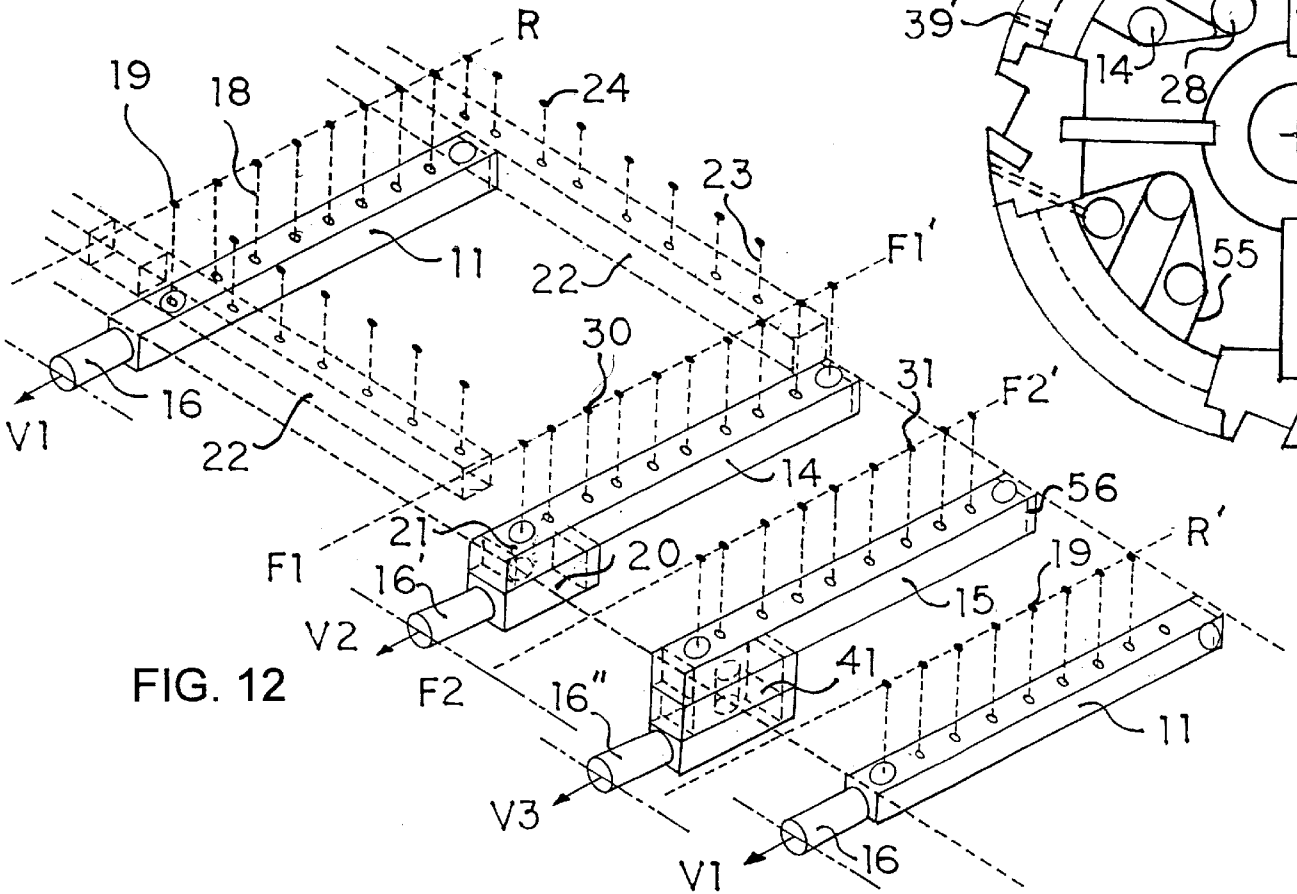
FIG. 12 is a perspective view of the vacuum conduit arrangement of FIG. 6 illustrating relationship of the hole patterns in FIG. 8 relative to front edge, rear edge, and fold lines (air conduits not shown for clarity)

In the left upper quadrant of FIG. 6, circumferential grooves 22 machined in the inside surface 13 A of the cylinder communicate with side margin vacuum ports 24 via channels 23 (shown in FIG. 12).

In FIG. 6, air conduit 28 (shown phantom) directs air flow to uplift the leading (quarter) panel of a double folded napkin through a similar path of channels and air apertures on the roll surface (not shown for clarity).

In FIG. 6, conduit 14 (see also FIG. 12) includes a circular extension 16 which bears against grooves 34 in the stationary valve half 33.

At the opposite end, conduits have closure means 56 (see right side of FIG. 12)

In FIG. 6, air conduits 28, 29 and vacuum conduits 11, 14, and 15 can also be supported by roll ends 17 (see FIG. 9) and 17' (not shown in FIG. 9), or by intermediate supports (not shown) between central shaft 37 and the roll shell 13.

In another embodiment,(see lower right quadrant of FIG. 6), conduit 16" is in sliding communication with vacuum groove V 3 and is connected to ports 31 in the cylinder surface 13 with metallic or flexible tubing 18" (tubing connection details omitted for clarity).

Similar tube/pipe connections can be made in any of the rolls described herein.

Figure 7:
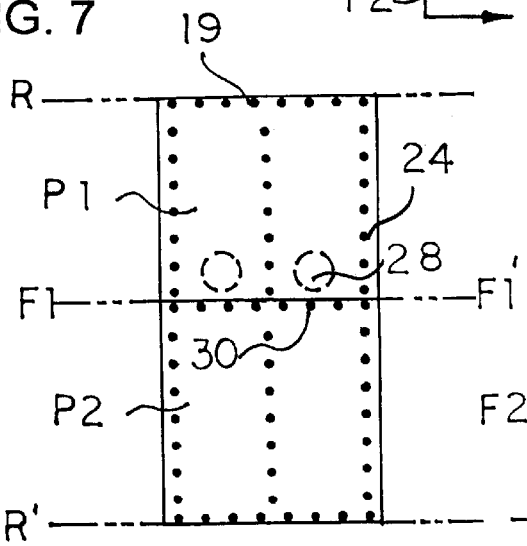
FIG. 7 is a plan view of the roll surface from sight line 7—7 of FIG. 6 illustrating the pattern of vacuum holes used to hold a longitudinally half folded segment during advancement for single transverse folding.
Figure 8:
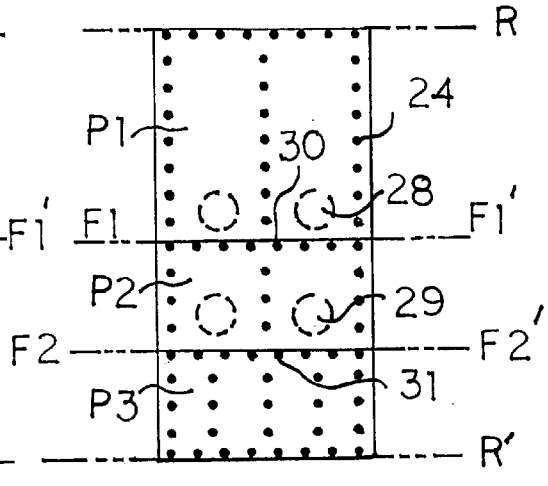
FIG. 8 is a plan view of the roll surface taken along sight line 8—8 of FIG. 6 illustrating the pattern of holes to hold a longitudinally half folded segment for double transverse folding.
Figure 9:
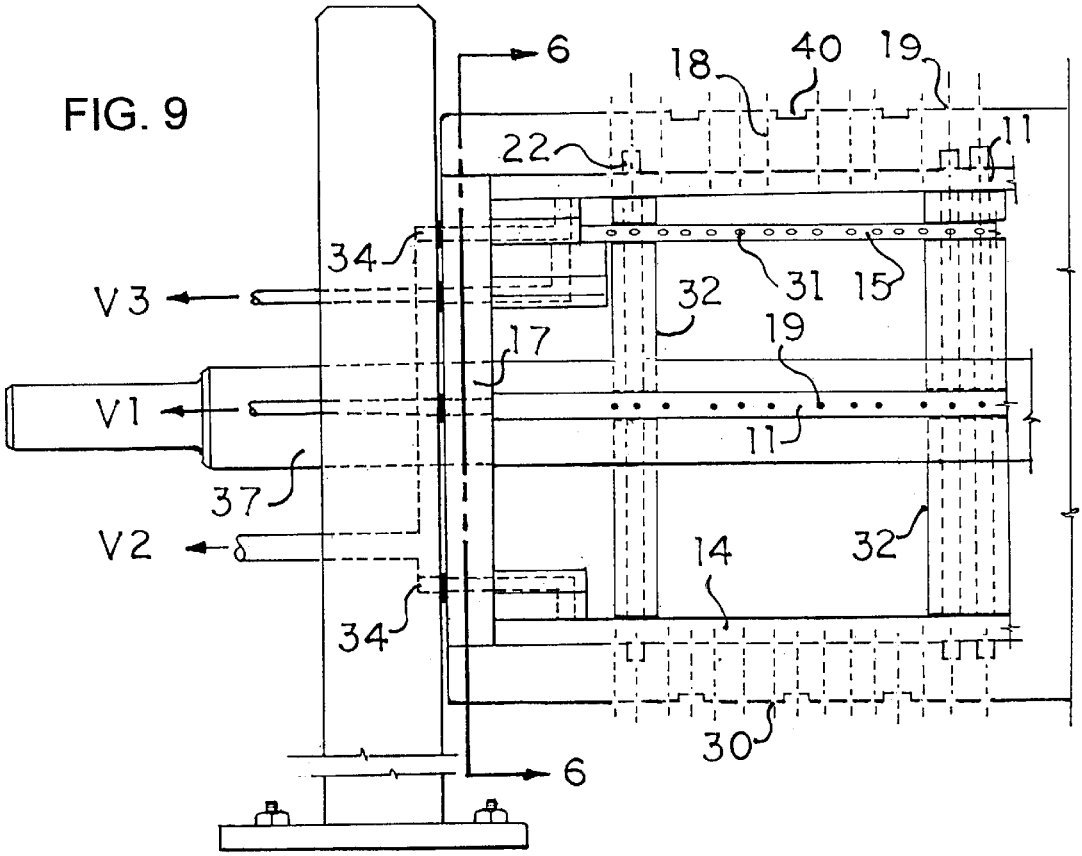
FIG. 9 is a side elevation schematic of the left end of the roll in FIG. 6 illustrating the sliding (cooperating) connection between the rotating roll and the stationary vacuum valve (right side of roll not shown).

FIGS. 7 and 8 show typical patterns of vacuum ports 19 in leading portion P 1 for connection to vacuum source V 1 (see FIG. 9), ports 30 in trailing portion P 2 for connection to V 2 of FIG. 9 and ports 31 in area P 3 (FIG. 8) for connection to V 3 of FIG. 9.

In FIGS. 7 and 8, the vacuum port layout is shown for one repeat length—from R to R'.

Midway between the ends of the article, a line of vacuum ports 30 defines fold line F 1–F 1' for a single transverse fold and midway between F 1–F 1 ' and the trailing end of the article, a second line of ports 31 defines a second fold line F 2–F 2'.

Figure 11:
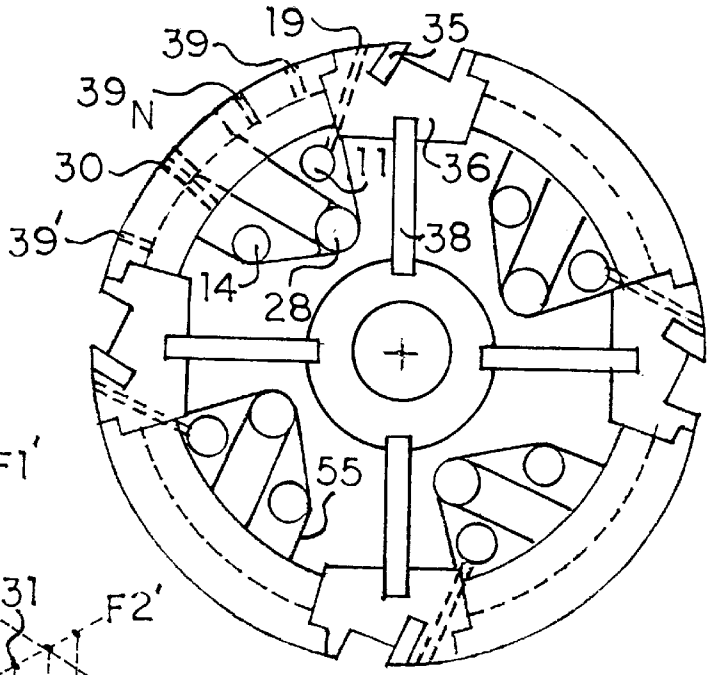
FIG. 11 is an end sectional view similar to FIG. 10 including anvils illustrating vacuum holes along product side margins communicating with circumferential grooves and a pre-molded 3-compartment conduit assembly for air and vacuum.

If the roll is used in the apparatus of FIGS., 5 or 6, air apertures 28, 29 (shown phantom in FIG. 8) are added and suitable air conduits and channels are provided (see 28 in the upper quadrant of FIG. 11).

In FIG. 9, side margin grooves 22 machined in the inside roll surface provise a U-shaped channel which connect to surface ports via holes drilled through the shell (see channel 23 and ports 24 in FIG. 12).

In FIG. 9, closure tapes 32 are superposed over the groove between consecutive conduits to form closed vacuum channels which communicate with ports in the roll surface.

Hollow rolls with separate vacuum conduits can be substituted for solid rolls with drilled conduits and channels, but the preferred air channels are not added to FIG. 9 for clarity. Conduits 28, 29 are added to cylinders used on the apparatus of FIGS. 5 and 6.

In FIG. 9, the non-rotating portions of a valve has annular grooves 34 with slidable blocks (not shown) to adjust the timing and duration of the applied vacuum.

In FIG. 9, roll end 17' (not shown), supports the opposite ends of conduits 11, 14, 15 and the roll shell.

Figure 10:
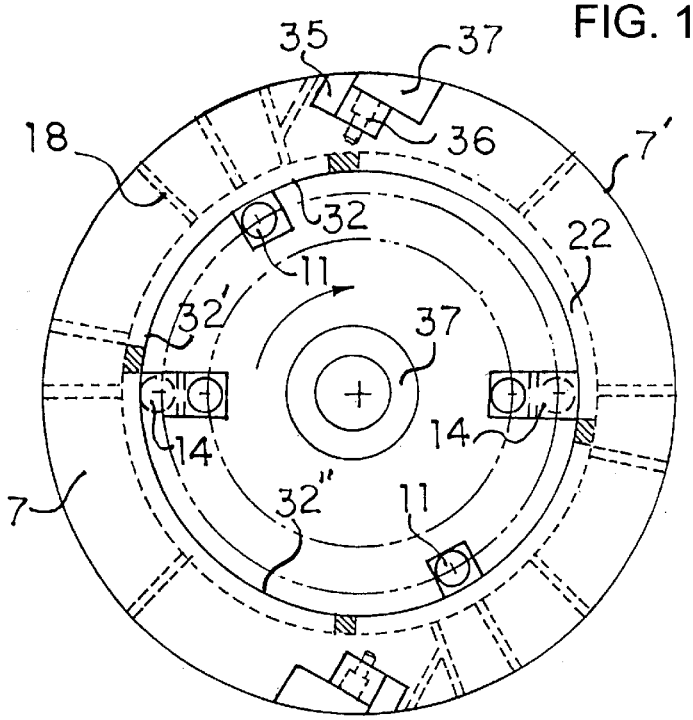
FIG. 10 is an end sectional view similar to FIG. 6 including mounted anvils illustrating the radially drilled holes between the roll surface and the circumferential groove on the inside surface.

FIG. 10 shows a 2-time roll for making single transverse folds for small repeats and narrow machines where anvil roll deflection are not a problem. In FIG. 10, anvil 35 and clamp 36 are mounted in cutout 36'.

In FIG. 11, anvil holders 36 are supported from central shaft 37 by radially extending anti-deflection members 38.

Figure 5:
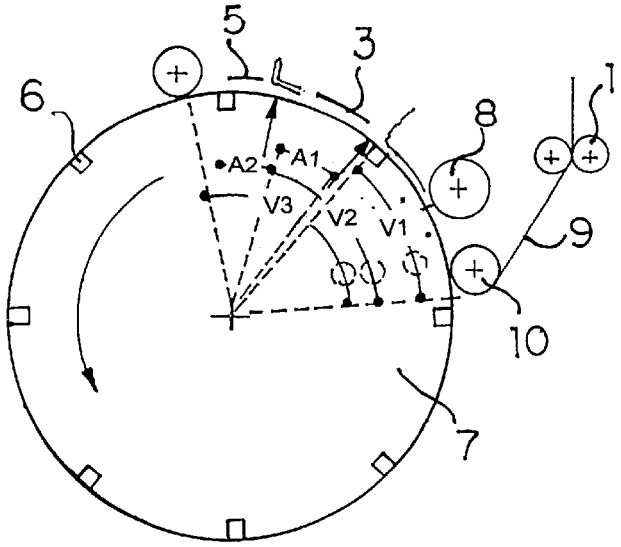
FIG. 5 is a diagrammatic sketch illustrating the timing and duration of vacuum and air operations to complete a single or double folded product on the machine of FIG. 4.

In FIG. 11, vacuum conduits 11 and 14, and air conduit 28 are separated parts of a pre-molded assembly 55, with the positions of each arranged according to V 1 and V 2 of FIG. 5.

Side margin vacuum ports 39 . . . 39*n* control the side edge of the leading half panel until a transverse line of ports 30 vacuum controls the segment at fold line F 1–F 1'.

In FIG. 12, side margins conduits 22, 22' are machined grooves on the inside surface of the roll. Grooves 22, 22' extend around the inside cylinder circumference but are not shown beyond F 1–F 1' for clarity.

The distance from R to F 1 is one half the product length. The distance from F 1 to R' is one half the product length with F 2 being centrally placed to define two consecutive quarter panels for double transverse folding.

In FIG. 12, spacer piece 41 is added to position vacuum connection 16" on pitch circle V 3.

In FIG. 12, each of the conduits 11, 14, and 15 have insert pieces 56 to close the conduit.

In FIG. 13, a hollow roll according to the instant teaching transfers a singlefolded segment 43 from the folding roll 7 to a belt delivery system 44.

A vacuum conduit 45 in transfer roll 46 controls the segment from nip position 47 until segment 43 is trapped between upper belts 48, 48' and lower belts 49, 49'.

Orbital packer 51 produces stacks of product which are transferred to packaging.

In FIG. 15, a slot 52 is machined in the inside surface of the roll and conduit 11 (and/or 14, 15) are fitted therein and secured with clamps).

An aperture (see arrow) in the side conduits 14 connects the vacuum path to circumferential grooves 22 (shown in FIG. 12).

In FIG. 16, a plenum chamber 53 is attached to the inside surface of a roll and directs air flow to apertures in the removable section 54 of roll shell 13.

While the foregoing detailed descriptions of preferred embodiments have been set forth for the porpose of explanation, any variation can be made in the details stated herein without departing from, or limiting, the spirit ans scope of the invention.

Having thus described the invention, I claim:

1. A roll assembly in an article folding apparatus comprising:

a hollow cylindrical shell having a thickness, an outer circumferential surge divisible by an integer, an inside surface, a central shaft having journals for rotational support in a frame, and shell support means from said central shaft, at least one vacuum conduit having open portions of one surface in superposed relationship with said inside surface, one end closure, and a rotating connection to an external vacuum source at the other end, said vacuum conduit communicating with radial channels in said shell and at least one plurality of vacuum ports in the outer surface of said cykindrical shell, said central shaft for rotation about an axis, a plurality of means to support said shell from said central shaft, wherein said plurality of vacuum ports includes at least a first pattern of vacuum ports in the leading portion of a repeat surface located on one side of a first fold line and at least one second pattern of vacuum holes in the trailing portion of a repeat surface located on the other side of said first fold line, and, wherein said vacuum conduit has flat surfaces, one of which contacts the inside surface of said shell.

2. The assembly of claim 1 wherein said conduits are closed at one end and said radial channel connentions to said vacuum include tubing.

3. The assembly of claim 1 including anvil supports and anvils mounted in cutouts in the outside circumferential surface of the cylinder shell, said, anvils for cutting coaction with knives mounted in a separate adjacent knife roll.

4. The assembly of claim 3 wherein a roll having anvils includes at least one support means between said central shaft and said anvil support means.

5. The assembly of claim 1 wherein said roll cutput arrangement includes means to clamp said anvils against said inside surface of said cylinder.

6. The assembly of claim 1 wherein the inside surface of said cylinder shell includes at least two annular vacuum grooves communicating with selected vacuum ports in the outside circumferential surface of said cylinder, said vacuum grooves in communication with {said} vacuum conduits.

7. The assembly of claim 1 wherein said leading portion of a repeat surface includes vacuumized ports and at least one air aperture communicating with an air conduit and a remote source for pressurized air.

8. The assembly of claim 7 wherein said vacuum and air conduits are parts of a pre-molded piece attached to the inside surface of said shell.

9. The assembly of claim 7 wherein air communicates with ports in the outer cylindrical shell by passing through a plenum chamber located on the inside Of said shell.

10. The assembly of claim 9 wherein a portion of said outside surface of said shell is removable and has a predetermined pattern of air pressure apertures selected from holes, slots, and other shapes including open mesh.

11. The assembly of claim 7 wherein at least one partial surface of said vacuum and air conduits is in contacting relationship with a longitudinal transverse slot cut in said inside surface of said cylinder shell.

12. The assembly of claim 1 wherein the elongated vacuum and air conduits are mounted parallel to the shaft of said cylinder, are spaced from the inside surface, include interconnecting means for fluid passage between conduits and said vacuum ports and air apertures, and include means for supporting conduits and the cylindrical shell.

13. The assembly of claim 1 wherein the rotating connection of a conduit for a first pattern of vacuum ports is radially offset from the rotary connection of a conduit for a second pattern of vacuum ports and rotationally communicates with a vacuum source on a different circle from the conduit end connector for said second pattern of vacuum ports.

* * * * *